US005150877A

United States Patent [19]

Whiteside et al.

[11] Patent Number: 5,150,877

[45] Date of Patent: Sep. 29, 1992

[54] FLUSH VALVE REFILL RING

[75] Inventors: John F. Whiteside, Franklin Park; Bradley S. Richardson, Chicago, both of Ill.

[73] Assignee: Sloan Valve Company, Franklin Park, Ill.

[21] Appl. No.: 833,749

[22] Filed: Feb. 11, 1992

[51] Int. Cl.[5] ..... F16K 31/385; F16K 31/145

[52] U.S. Cl. ..... 251/40; 251/38; 251/120; 251/123

[58] Field of Search ..... 251/40, 38, 120, 123

[56] References Cited

U.S. PATENT DOCUMENTS

| | | | |
|---|---|---|---|
| 2,012,255 | 8/1935 | Binnall | 251/40 X |
| 3,656,499 | 4/1972 | Nelson et al. | 251/120 X |
| 5,013,007 | 5/1991 | Whiteside | 251/40 |

*Primary Examiner*—Arnold Rosenthal

*Attorney, Agent, or Firm*—Kinzer, Plyer, Dorn, McEachran & Jambor

[57] ABSTRACT

A flush valve body has a passage which connects the inlet and outlet. There is a valve seat at one end of the passage and a diaphragm is positioned to control the flow of water through the passage and to close upon the seat. A guide member is attached to the underside of the diaphragm and a refill ring is attached to the guide member. The improvement is specifically directed to the exterior of the refill ring which has a plurality of recesses to channel the flow of water through the flush valve passage. The recesses have a portion of constant size and a portion of gradually changing size. There are fins which separate the recesses and the fins are always in contact with the interior of the passage. The stroke of the diaphragm when moving between fully open and fully closed positions is approximately one-half of the axial length of the refill ring.

6 Claims, 2 Drawing Sheets

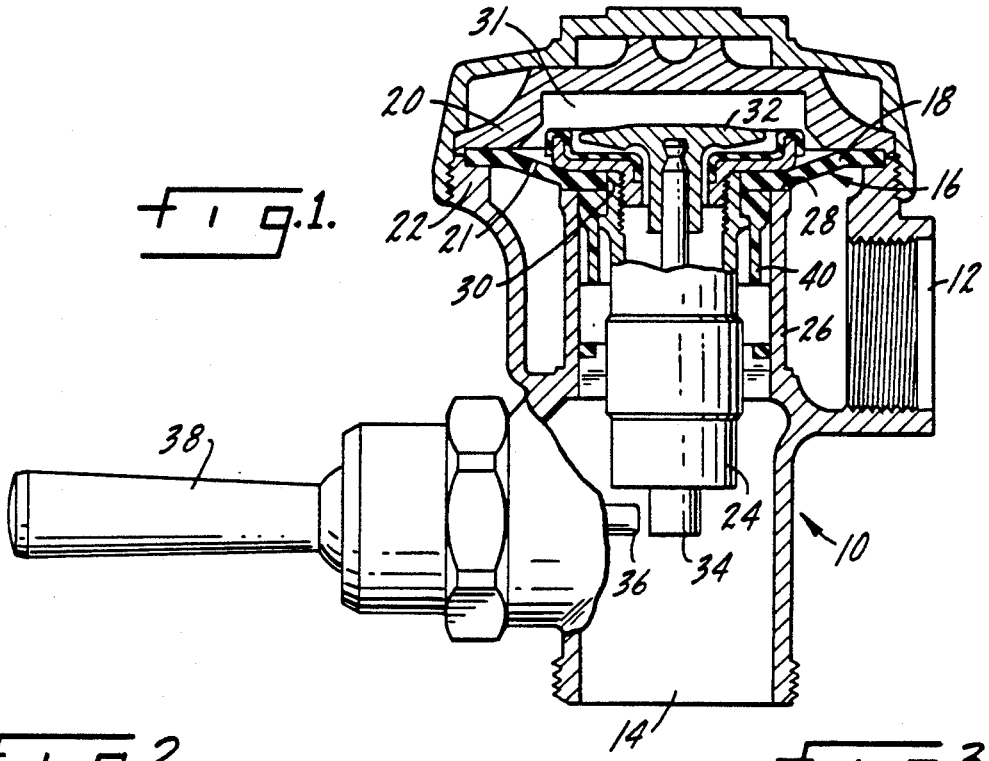
Fig. 1.
Fig. 2.
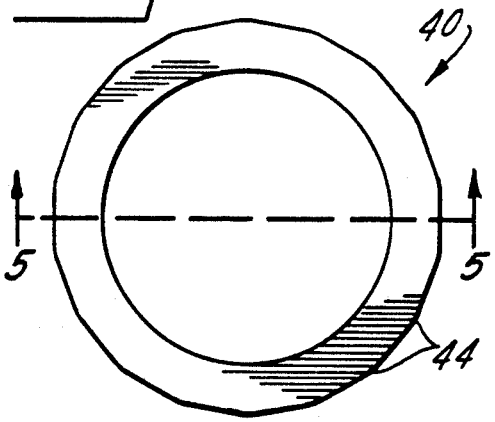
Fig. 3.
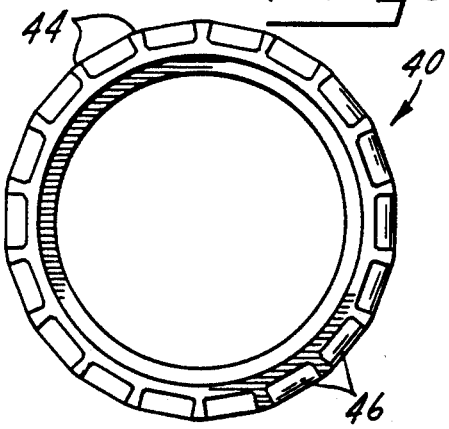
Fig. 4.
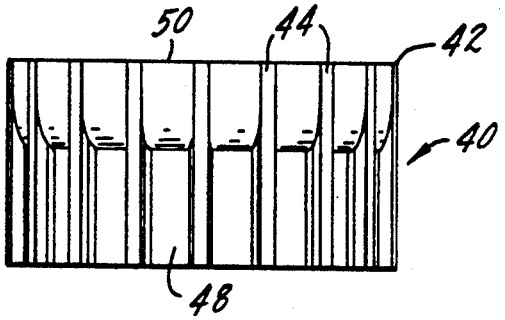

FLUSH VALVE REFILL RING

THE FIELD OF THE INVENTION

The present invention relates to flush valves of the type commonly found in public washrooms and more particularly to the refill ring which modulates the flow of water through the flush valve during its operation. The present invention is specifically concerned with a refill ring which eliminates vibration noise and noise caused by an abrupt closure of the flush valve. Further, the refill ring is specifically designed to accurately control the flow of water and to provide a controlled closing of the flush valve.

THE RELATED PRIOR ART

U.S. Pat. No. 5,013,007 owned by Sloan Valve Company, the assignee of the present application, discloses a refill ring which is designed to eliminate both vibration noise during operation of the flush valve and water hammer at closure of the flush valve. The present invention is specifically directed to an improvement of what is shown in the '007 patent. U.S. Pat. No. 3,656,499, also owned by Sloan Valve Company, shows an earlier form of refill ring and one which has been in common use in flush valves for a substantial number of years. The refill ring in the '499 patent was expensive to manufacture and difficult to hold to tolerance. Further, the ring did not provide sufficient noise reduction, nor was it capable of accurately controlling the flow of water through the flush valve at closure.

SUMMARY OF THE INVENTION

The present invention is related to refill rings for use in flush valves of the type commonly found in public washrooms and specifically to improvements in the refill ring which permit more accurate control of the flow of water through the flush valve and a substantial reduction of noise when compared with prior art refill rings.

A primary purpose of the invention is a refill ring for the use described which is always in peripheral contact with the passage through which it moves to avoid vibration noise and which gradually reduces the flow of water at closure to eliminate water hammer.

Other purposes will appear in the ensuing specification, drawings and claims.

BRIEF DESCRIPTION OF THE DRAWINGS

The invention is illustrated diagrammatically in the following drawings wherein:

FIG. 1 is a partial axial section through a flush valve of the type described showing the improved refill ring of the present invention, FIG. 2 is an enlarged top view of the refill ring of FIG. 1, FIG. 3 is a bottom view of the refill ring of FIG. 1 on the same scale as FIG. 2, FIG. 4 is a side view of the refill ring.

DESCRIPTION OF THE PREFERRED EMBODIMENT

Figure 5:
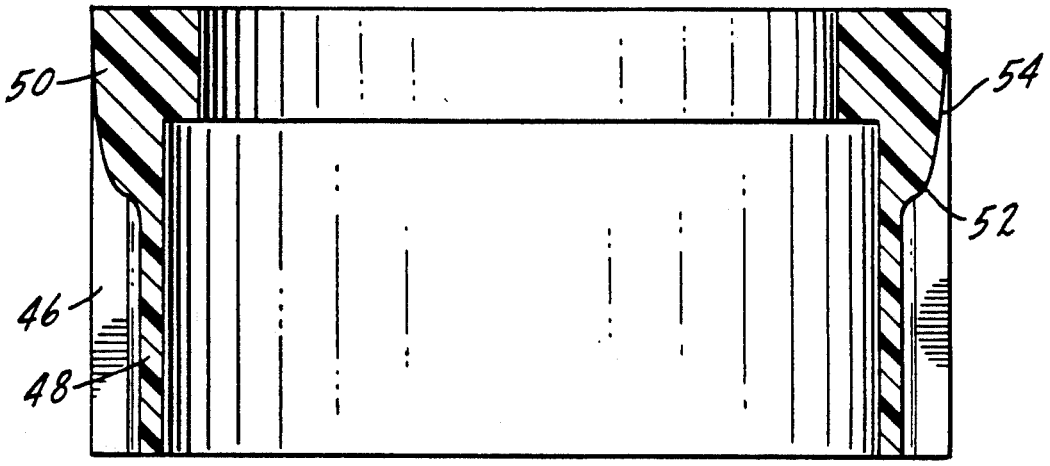
FIG. 5 is a section along plane 5—5 of FIG. 2.
Figure 6:
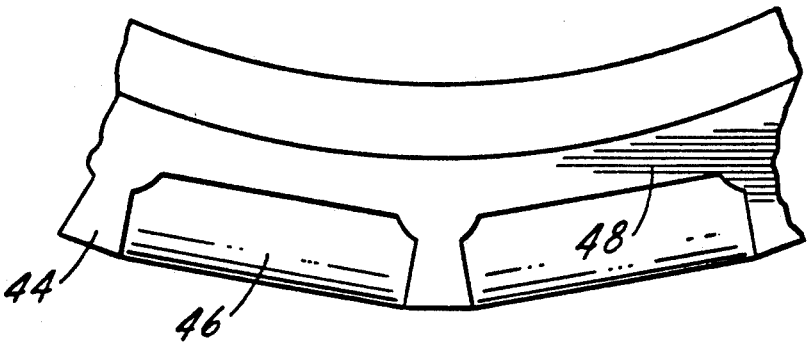
FIG. 6 is an enlarged partial bottom view of the refill ring.

U.S. Pat. No. 3,656,499, assigned to the assignee of the present invention, describes a diaphragm-type flush valve and a refill ring for use in that flush valve which has been in commercial use for a number of years. The refill ring was specifically designed to quiet the closure of the diaphragm upon its seat during operation of the flush valve. The exterior of the refill ring has a plurality of grooves which are designed to reduce water turbulence during closure of the diaphragm assembly and there is an annular space about the periphery of the refill ring which forms a passage between the interior of the flush valve barrel and the exterior of the refill ring. As the diaphragm assembly is closed, water flows through this passage, with the grooves which form the interior wall of the passage functioning to reduce turbulence and thus noise. The presence of a very large number of vertical grooves in the periphery of the refill ring made the part expensive to manufacture and difficult to hold to tolerance. The result was that the flow of water past the refill ring during closure varied greatly, because of the difficulty of precisely controlling the size of the passage about the exterior of the refill ring.

U.S. Pat. No. 5,013,007 was an improvement on what is shown in the '499 patent and there were a plurality of areas of circumferential contact between the refill ring and the interior of the flush valve barrel, something not present in the '499 patent. However, the recesses which form the water passages in the refill ring of the '007 patent were constant in shape and cross section, which caused the flow of water through the refill ring to be more abrupt than desired. The present invention is specifically an improvement on what is shown in the '007 patent.

In the drawings, a flush valve body is indicated generally at 10 and has an inlet 12 and an outlet 14. The diaphragm assembly is indicated generally at 16 and includes a flexible diaphragm 18 clamped about its periphery between an internal cover 20 and a shoulder 22 formed in the flush valve body 10. A guide member 24 is attached to the diaphragm and extends within a barrel 26 of the flush valve, the barrel forming a passage between the inlet and the outlet. At the top of the barrel there is a seat 28 upon which the diaphragm assembly closes.

The diaphragm is provided with a central opening 30 within which is positioned a relief valve 32, the lower end of which, indicated at 34, is positioned for contact by plunger 36. As is well known in the art, plunger 36 is operated by movement of handle 38. The description and function of the flush valve are more fully described in U.S. Pat. No. 3,656,499, and the disclosure of that patent is incorporated herein by reference.

The refill ring is indicated at 40 and may be formed of a suitable plastic material, for example Delrin or Celcon. The ring is generally cylindrical in form and has an upstream end 42 having a diameter approximately the same as the interior diameter of barrel 26, with the result that there is spaced peripheral contact between the refill ring and the barrel. The contact is along a plurality of axially extending, somewhat wedge-shaped fins 44 which extend the axial length of the refill ring, with the fins having a constant outer dimension. Thus, the fins are in substantial contact with the interior of passage 26 to provide frictional resistance to movement of the refill ring. This is desirable as axial contact between ring 40 and barrel 26 removes any possible vibration of the refill ring as the water flows through the flush valve. A frictional force of approximately 10–12 lbs. has been found to be satisfactory.

The area between the fins 44 forms a plurality of recesses 46 which are the passages through which water flows when the flush valve is operated. Each recess or water flow path 46 has a first portion 48, adjacent the downstream end of the ring, which has a generally constant cross section. The axial extent of this first portion 48 is slightly greater than one-half the axial length of the refill ring. The recesses 46 have a second portion, indicated at 50, and more particularly shown in the cross section of FIG. 5. The portion 50 is curved, with the curvature being sharper in the area 52 adjacent the constant cross section portion 48 of the recesses. The curvature is more gradual in the area 54 which is generally adjacent the upstream end of the refill ring. The described curvature is very desirable as flow through the flush valve will gradually terminate, eliminating the possibility of water hammer.

In operation, the stroke of the diaphragm and refill ring, which is the distance the diaphragm moves away from its seat 20 when the valve is open, is approximately equal to one-half of the axial length of the refill ring. The refill ring is never out of contact with the inside of barrel 26. In the full up position of the diaphragm and refill ring, the top of portion 48 of constant cross section will be at or just above the seat 28. Water will flow through the recesses 46 after the flush valve is opened.

Closure of the flush valve begins when water flows through bypass orifice 21 into the chamber 31 above the relief valve 32. As pressure increases in this chamber, the diaphragm will move toward a closure with seat 28. Water will then be flowing only through the gradually decreasing flow areas 50 of recesses 46. The final closing movement of the diaphragm will not be abrupt as in the prior art, but will be gradual, as the curved portion 54 of each recess gradually decreases the cross sectional area through which water can flow.

It is important that the size of the recesses 46 be accurate in order to accurately control the volume of water used in a flushing operation. The fins 44 function not only to avoid vibration of the refill ring as water flows through it, but also to separate the periphery of the ring into a plurality of recesses. If the size and configuration of one recess is slightly in error, this error or out-of-tolerance condition will not necessarily be present in any other of the recesses, with the result that the average flow through the refill ring can be carefully controlled. The depth of the recesses, as well as the size, will be designed to provide a given flow of water, both immediately after opening of the flush valve and during closing. The greater the number of contoured recesses, the less the variance in tolerance of any one recess will have on the total flow through the refill ring.

Whereas the preferred form of the invention has been shown and described herein, it should be realized that there may be many modifications, substitutions and alterations thereto.

The embodiments of the invention in which an exclusive property are claimed are defined as follows:

1. In a flush valve, a body having an inlet and an outlet, a passage connecting the inlet and outlet, a valve seat at one end of said passage, a diaphragm positioned to control the flow of water through said passage and to close upon said seat, a guide member attached to the underside of said diaphragm and positioned within said passage, a refill ring attached to said guide member adjacent the diaphragm, said refill ring having an upstream end which is in spaced peripheral contact with said passage when said diaphragm is closed on said valve seat, said refill ring having a plurality of exterior axially extending circumferentially spaced fins in contact with said passage, the spaces between fins providing water flow paths which modulate the flow of water through said passage as said diaphragm closes on said valve seat, each water flow path having a first portion of generally constant flow area adjacent the downstream end of said refill ring, and a second portion which connects the first portion with the upstream end of said refill ring, said second portion gradually decreasing in flow area from said first portion to the upstream end of said refill ring.

2. The flush valve of claim 1 further characterized in that said water flow path first portion extends for at least one-half of the axial length of said refill ring.

3. The flush valve of claim 1 further characterized in that said second flow path portion has a gradually changing curved interior surface in which the greatest change in curvature is adjacent the first flow path portion.

4. The flush valve of claim 1 further characterized in that the stroke of said refill ring as said diaphragm moves between open and closed positions is approximately one-half the axial length of said refill ring.

5. The flush valve of claim 1 further characterized in that each fin has a wedge-shaped cross section.

6. The flush valve of claim 1 further characterized in that each flow path has an interior wall which is spaced a constant distance from said passage for at least one-half of the axial extent of said refill ring, with the remaining space between said interior wall and said passage gradually decreasing toward the upstream end of said refill ring.

* * * * *